US006202623B1

(12) United States Patent
Ehrlich

(10) Patent No.: US 6,202,623 B1
(45) Date of Patent: Mar. 20, 2001

(54) INTERNAL COMBUSTION ENGINES

(75) Inventor: Josef Ehrlich, Hertfordshire (GB)

(73) Assignee: Preservation Holdings Limited, Jersey (GB)

( * ) Notice: Subject to any disclaimer, the term of this patent is extended or adjusted under 35 U.S.C. 154(b) by 0 days.

(21) Appl. No.: 09/522,596

(22) Filed: Mar. 10, 2000

Related U.S. Application Data

(63) Continuation of application No. PCT/GB98/02643, filed on Sep. 3, 1998.

(30) Foreign Application Priority Data

Sep. 12, 1997 (GB) ..... 9719536

(51) Int. Cl.[7] ..... F02B 41/00
(52) U.S. Cl. ..... 123/197.4; 123/78 E; 123/197.3
(58) Field of Search ..... 123/48 B, 78 E, 123/78 F, 197.3, 197.4

(56) References Cited

U.S. PATENT DOCUMENTS 2,506,088 5/1950 King .
4,890,589 1/1990 Miyate .
5,218,933 6/1993 Ehrlich .
6,009,845 1/2000 Ehrlich ..... 123/197.4

FOREIGN PATENT DOCUMENTS 0 248 655 12/1987 (EP) .

*Primary Examiner*—Noah P. Kamen
(74) *Attorney, Agent, or Firm*—Finnegan, Henderson, Farabow, Garrett & Dunner, L.L.P.

(57) ABSTRACT

An internal combustion engine having one or more pistons (4), each of which is mounted to reciprocate in a respective cylinder (2) and is pivotally connected to a connecting rod (6) which is connected to a respective crank (10) on a crankshaft (7). The connecting rod (6) is pivotally connected to one end (11) of an elongate link (14) which is pivotally connected to an associated crank (10) at a point intermediate its ends and whose other end constitutes a rod (18) which is restrained by a mounting (20, 26) such that it may pivot about a pivotal axis (21) parallel to the axis (8) of the crankshaft (7). The mounting includes a first movable mounting member (20) connected to a second movable mounting member (26) to be pivotable with respect thereto about the pivotal axis (21). The first movable mounting (20) is connected to the rod (18) by a connection with permits only relative sliding movement in the direction of the rod (8). An actuating device (30, 32) is connected to the mounting and is arranged to move the mounting selectively in a first direction perpendicular to the axis (8) of the crankshaft (7) and in a second direction perpendicular thereto.

12 Claims, 1 Drawing Sheet

INTERNAL COMBUSTION ENGINES

This application is a continuation of International Application No. PCT/GB98/02643, filed Sep. 3, 1998, the content of which is incorporated herein by reference.

BACKGROUND OF THE INVENTION

The present invention relates to internal combustion engines of reciprocating piston type and is concerned with such engines which include one or more pistons, each of which is mounted to reciprocate in a respective cylinder and is pivotally connected to a connecting rod which is connected to a respective crank on a crankshaft, the connecting rod being pivotally connected to one end of an elongate link member which is pivotably connected to the associated crank at a point intermediate its ends and whose other end constitutes a rod which is restrained by a mounting such that it may pivot about a pivotal axis parallel to the axis of the crankshaft. The invention is also particularly, though not exclusively, concerned with engines of the general type disclosed in EP-A-0591153.

SUMMARY OF THE INVENTION

This prior document discloses an engine in which the or each piston is caused to move over at least a portion of the cycle at a rate which is such that the graph of its displacement against time differs from the sinusoidal shape which is inherently produced in conventional engines in which each piston is connected to a respective crank on a crankshaft by a respective connecting rod. In such a conventional engine attempts are made to match the combustion of the fuel/air mixture to the motion of the piston but the philosophy underlying the construction of the prior document is that the combustion is permitted to proceed in the optimum manner and the piston is caused to move in a manner which "follows" the combustion and is related to the nature and progress of the combustion process.

BRIEF DESCRIPTION OF THE DRAWING

Further features and details of the invention will be apparent from the following description of one specific embodiment which is given by way of example with reference to the accompanying highly diagrammatic drawing, which is a partly sectional scrap view of part of a multi-cylinder four stroke engine of which only one cylinder and the associated piston and the piston connecting mechanism are shown.

DETAILED DESCRIPTION OF THE INVENTION

Figure 1:
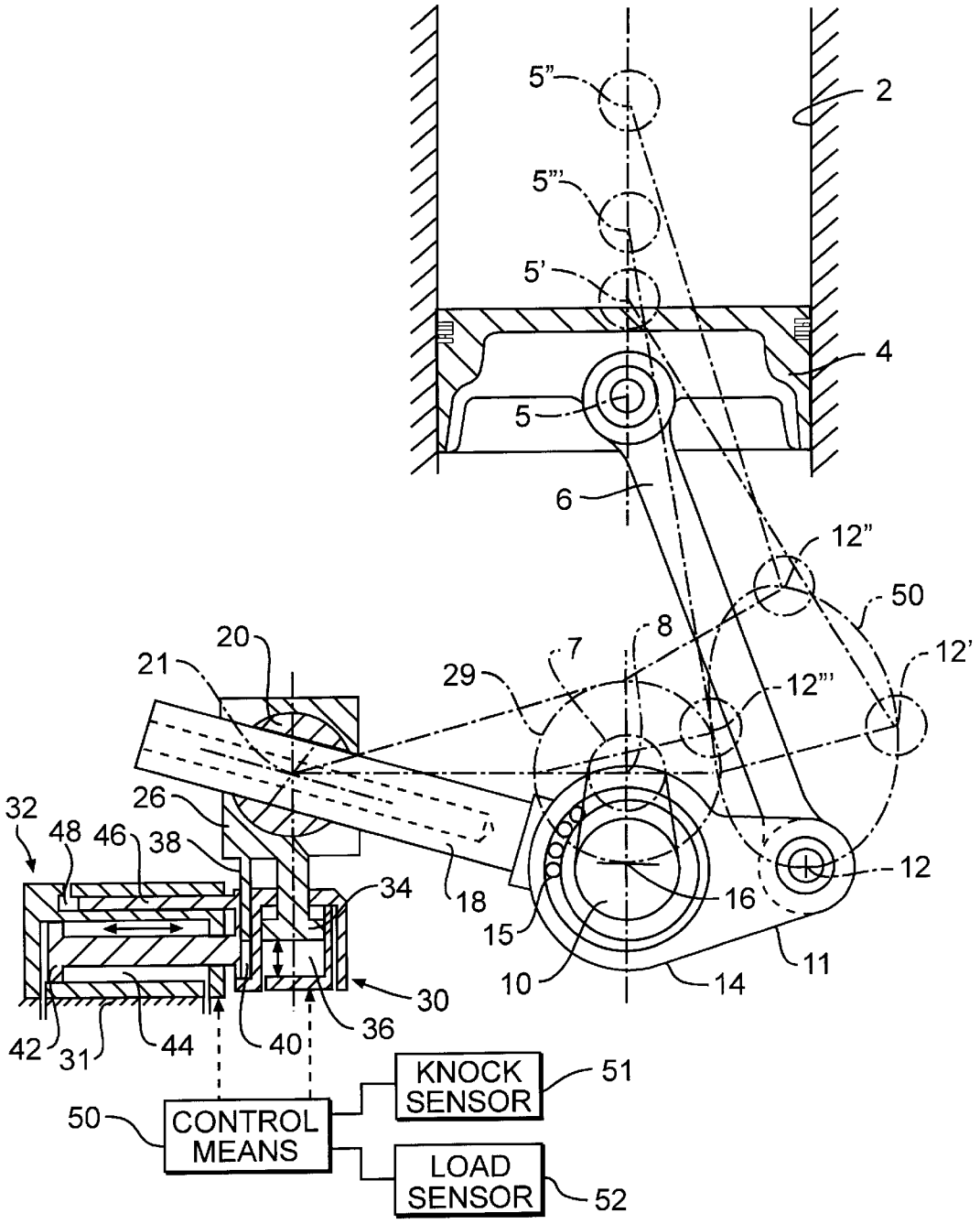

More specifically, the prior document discloses an engine in which the piston is caused to decelerate and thus to move more slowly than in a conventional engine at or around the point in the cycle at which ignition of the fuel/air mixture occurs and then to speed up again prior to reaching the top dead centre position (TDC). This is based on the recognition that in a conventional engine the piston is moving at substantially its maximum speed at the point at which ignition occurs and the compression ratio is altering at substantially its maximum rate and thus impedes the rate of propagation of the flame front through the fuel/air mixture and thus impairs the nature and completeness of the combustion process. However, slowing the piston down at around the ignition point means that the rate of increase in the pressure of the fuel/air mixture at the time propagation of the flame front commences is substantially less than is usual which results in the flame front propagating through the fuel/air mixture very much more rapidly than as usual.

The prior document also discloses that the piston is caused to reach its maximum acceleration and maximum speed at something between 0 and 40° after TDC, instead of 90° after TDC as in a conventional engine, and thereafter to move more slowly than in a conventional engine in the latter portion of its working stroke prior to reaching the bottom dead centre position (BDC). This results in a decreased temperature of the exhaust gases and thus in reduced emissions of NOx and reduced erosion of the exhaust ports and valves.

Extensive tests have been conducted on engines constructed in accordance with EP-A-0591153 and these have shown that the engine does indeed have a substantially increased efficiency by comparison with conventional engines and also dramatically reduced emissions of unburnt hydrocarbons CO and NOx. Indeed, these tests have shown that the combustion process in the engines in accordance with the prior document proceeds in a manner which is fundamentally different to that in conventional engines, as evidenced by the fact that, for instance, the rate of pressure rise in the cylinder during combustion is about 6.5 bar per degree of rotation of the output shaft, as compared with about 2.5 bar in a conventional engine and that the combustion is complete within about 22° rotation of the output shaft after TDC, as compared to about 60° in a conventional engine.

However, the engine disclosed in the prior document incorporates profiled cams cooperating with the pistons and not a conventional crankshaft and whilst such cams are wholly functional and technically satisfactory it would be preferable for the engine to incorporate a crankshaft of generally conventional type because mass manufacturing facilities for crankshafts are already available and the technology for manufacturing crankshaft type engines is more familiar and tried and tested than that for cam type engines.

Accordingly it is the object of the present invention to produce an internal combustion engine of reciprocating piston type in which the time displacement graph of the or each piston differs from the sinusoidal shape of conventional crankshaft type engines, e.g. in a manner similar to that disclosed in EP-A-0591153, and may also be altered, when the engine is in operation, but which includes a crankshaft of generally conventional type.

An engine of the specific type to which the invention relates is disclosed in U.S. Pat. No. 2,506,088. In the engine disclosed in this prior document the other end of the elongate link member, i.e. the end furthest from the piston, is pivotally connected to one end of a short arm whose other end is mounted on a fixed pivot for rotation thereabout. As the piston reciprocates and the associated crank rotates about the axis of the crankshaft, the other end of the link member is constrained by the short arm to rotate with it about the fixed pivot at a speed equal to that of the crankshaft.

The pattern of motion of the piston in this engine will differ from the truly sinusoidal but in a manner which is predetermined and unalterable. However, in order to optimise the combustion of the air/fuel mixture for the purpose of maximising efficiency and minimising emissions it is desirable that means be provided to alter the pattern of motion of the piston in dependence on speed, load or other parameters.

It is therefore a further object of the present invention to provide an engine, preferably one which operates in accordance with the teaching of EP-A-0591153, in which the pattern of motion of the engine is alterable, preferably automatically, in dependence on the engine operating parameters.

According to the present invention, an internal combustion engine of the type referred to above is characterised in that the mounting includes a first movable mounting member connected to a second movable mounting member to be pivotable with respect thereto about the pivotal axis, the first movable mounting member being connected to the rod by a connection which permits only relative sliding movement in the direction of the rod and that actuating means is connected to the mounting and is arranged to move the mounting selectively in a first direction perpendicular to the axis of the crankshaft and in a second direction transverse thereto.

Thus in the engine of the present invention the connecting rod is not directly pivotally connected to a respective crank but indirectly via one end of a link member which is pivotally connected to both the crank and the connecting rod. The other end of the link member is mounted so as to be pivotable about a third pivotal axis, which will be parallel to the other two, and to be linearly movable parallel to its length. The motion of piston will thus differ from the sinusoidal and may be varied at will by varying the spacing and relative positions of the three pivotal axes of the link member, which will in general not lie in a single plane. It is, however, preferred that the three pivotal axes are so positioned that the motion of the piston closely mimics that of the piston of the engine disclosed in EP-A-0591153, in particular that the piston is caused to move significantly more slowly at around the ignition point than in a conventional engine.

The invention is applicable to both two-stroke and four-stroke engines of both spark-ignited and diesel type. It will be appreciated that the actuating means permits the third pivotal axis, that is to say the axis about which the rod rotates with respect to the mounting, to be moved at will thereby altering the motion of the piston. This may be desirable to permit the engine to run optimally at differing speeds and/or loads and indeed may be used to vary the swept volume of the or each cylinder and the compression ratio of the engine, as will be discussed in more detail below. In the event that the engine is of four-stroke type, it may be desirable for the motion of the piston to differ between the compression and exhaust strokes and perhaps even between the induction and working strokes also. This may be achieved in a variety of manners, e.g. by causing the mounting to reciprocate linearly in synchronism with the associated piston. The actuating means may be used not only to vary the manner in which the movement of the piston varies from the sinusoidal but may also be used, at least in part, to produce the variation and thus may be actuated during the course of a stroke of the piston, e.g. at or around the ignition point to produce the desirable deceleration of the piston at that point. It is also preferred that the elongate link and the mounting are so dimensioned and arranged that, when the engine is in operation, the pivotal axis about which the connecting rod pivots with respect to the elongate link member describes a generally oval or elliptical path, the major axis of the ellipse extending generally parallel to the axis of the cylinder.

The first direction in which the mounting is movable is preferably substantially parallel to the axis of the cylinder and the second direction is preferably substantially perpendicular to the axis of the cylinder.

It is preferred that the actuating means comprises a first actuator, which is connected to the mounting and is arranged to move it in one of the two directions, and a second actuator, which is connected to the first actuator and is arranged to move it and the mounting in the other of the two directions. The two actuators may be of various different known types but it is preferred that they are of hydraulic type.

The actuators are preferably under the control of control means which is arranged selectively to operate them. The control means will typically be the engine management system as is now provided in most modern automotive engines.

The ability to move the mounting in any desired direction perpendicular to the axis of the crankshaft by means of the two actuators permits the pattern of motion of the piston to be varied at will and, in particular, to be varied in accordance with the engine operating parameters to optimise performance of the engine at all times. It is found that movement of the mounting in the first direction, that is to say substantially parallel to the axis of the cylinder, results principally in movement of the top dead centre position of the piston and thus in a change in the compression ratio of the engine. Such movement also results, though to a lesser extent, in a change in the stroke of the piston and of the swept volume. It is found that movement of the mounting in the second direction, that is to say substantially perpendicular to the axis of the cylinder, results primarily in movement of the bottom dead centre position of the piston and thus primarily in a change in the stroke and thus in the swept volume of the piston. The present invention thus opens up the possibility of varying the compression ratio and the swept volume of the engine, within limits set by the geometry of the components, at will to match the engine to the instantaneous operating parameters.

It is preferred that the engine includes a first sensor arranged to produce a signal indicating that knocking of the engine has commenced or is about to commence, the control means being arranged to operate the actuating means to move the mounting in the first direction to reduce the compression ratio and thus to cause the knocking to stop. Such knock sensors are well known and comprise an acoustic or vibration sensor located in or on the cylinder block and permit the compression ratio of the engine to be temporarily reduced in the event that knocking occurs so as to maximise efficiency.

It is preferred also that the engine includes a second sensor arranged to produce a signal indicative of the load on the engine, the control means being arranged to move the mounting in the first direction to vary the compression ratio of the engine with changing load, e.g. decrease the compression rate as the load increases. Such load sensors are also well known per se and may be exposed e.g. to the pressure in the engine inlet manifold which rises as the load on the engine increases or may be mechanically linked to the engine throttle.

Movement of the mounting in the first direction will cause the compression ratio of the engine to change and will also cause the swept volume and stroke of the piston to change slightly. This will alter the ignition timing, which is undesirable and it may also be unacceptable, for instance in racing engines, for the swept volume to alter and both of these changes can be compensated for if the control means is arranged to move the mounting in the second direction, thereby altering the bottom dead centre position of the piston, to compensate for changes caused by movement of the mounting in the first direction.

The optimum compression ratio of an engine varies with the load to which it is subjected and this optimum compression ratio increases as the load decreases. It is therefore possible with the aid of the present invention to ensure that the compression ratio is always at the optimum value but that knocking of the engine does not occur. Thus if, for instance, the engine is operating at low speed and load and the load is suddenly increased there is an instantaneous tendency for knocking or pre-ignition to occur. This may be counteracted by temporarily reducing the compression ratio by moving the mounting in the first direction and optionally compensating for this by moving it also in the second direction. As the speed of the engine increases the control means is desirably programmed to produce a progressive increase in the compression ratio also to the optimum value just below that at which knocking would occur.

Alternatively, the control means may be arranged to ensure that if the load on the engine suddenly increases the mounting is moved in the second direction to effect a significant increase in the volume swept by the piston. Thus if a sudden increase in power from the engine is required the capacity of the engine may be increased by e.g. 10% thereby resulting in an instantaneous significant increase of the power output. The present invention may therefore be used to produce a power increase effect similar to that produced by a turbocharger or supercharger and may be used to replace conventional, expensive superchargers or simply to enable an engine of one capacity to be altered to be of different capacity.

Whilst the two portions of the link member on opposite sides of the crank to which it is pivotally connected may be co-linear, it is found to be preferable if they are in fact somewhat inclined to one another, e.g. by between 5 and 45°.

The increase in the speed of flame propagation and efficiency of combustion in the cylinder result in a very substantial increase in efficiency of the engine, that is to say power output per unit mass of fuel. The efficiency is further increased by the fact that the connecting rod is inherently inclined to the cylinder axis when the piston is at the top dead centre position (TDC). The maximum pressure within the cylinder is produced at or around TDC but in a conventional engine the connecting rod and the crank define a straight line parallel to the cylinder axis at TDC which means that no torque is transmitted to the crankshaft at that position and the high pressure within the cylinder is "wasted" and results merely in the generation of additional heat. However, in the engine in accordance with the present invention, the fact that the connecting rod is inclined to the cylinder axis at TDC means that torque is transmitted to the crankshaft at TDC and thus that the high pressure prevailing at TDC is converted into useful output and is not wasted.

In the embodiment as shown in the drawing the engine has four cylinders, though it may have more or less than this or even only a single cylinder, but only a single cylinder 2 is shown. Reciprocably mounted in the cylinder is a piston 4. The piston is pivotally connected about an axis 5 in the usual manner to a connecting rod 6. Extending below the or each cylinder 2, is a crank shaft 7, which is shown only diagrammatically in FIG. 1 and is mounted to rotate about an axis 8. The crankshaft carries a respective crank or crank throw 10 for each piston. The connecting rod 6 is, however, not directly connected to the associated crank 10 but is instead pivotally connected about an axis 12 to one end 11 of a respective elongate link 14. The link is also pivotally connected about an axis 16 at a point intermediate its ends to the associated crank 10, with the interposition of an appropriate bearing 15. The other end 18 of the link 14, which is in the form of a hollow bar, is longitudinally slidably received in a mounting.

The mounting includes a first movable mounting member 20, which is constituted by a ball or cylinder and affords a hole through which the bar 18 passes and is slidably retained therein. The movable mounting member 20 is retained in a hole or recess within a second movable mounting member 26 by virtue of the engagement of its circular section external surface by opposed complementary surfaces afforded by the mounting member 26. The mounting member 20 may thus rotate with respect to the mounting member 26 about its central axis 21 but may not move linearly with respect to it. The rod 18 may thus move only in rotation and linearly parallel to its length with respect to the mounting member 26.

The mounting 20, 26 is connected to two hydraulic actuators 30, 32 arranged to move it linearly in two directions which are mutually perpendicular to each other and are both perpendicular to the axis 8 of the crankshaft. The first actuator 30 carries the mounting and is arranged to move it substantially parallel to the axis of the cylinder and is in turn carried by the second actuator 32 which is arranged to move it and thus also the mounting substantially perpendicular to the axes of both the crankshaft 7 and of the cylinder 2. The second actuator 32 is rigidly attached to some fixed component 31 of the engine and is thus stationary.

Rigidly connected to the second mounting member 26 is a piston 34 which is accommodated in the cylinder 36 of the first actuator. Also connected to the second mounting member 26 is an elongate guide member 38 which is slidably received in the manner of a piston in a vented cavity 40 in the first actuator and ensures that the mounting moves smoothly and linearly with respect to the first actuator. Similarly, rigidly connected to the first actuator 30 is a piston 42 which is accommodated in the cylinder 44 of the second actuator 32. Also connected to the second actuator is an elongate guide member 46 which is slidably received in the manner of a piston in a vented cavity 48 in the second actuator and ensures that the first actuator moves smoothly and linearly with respect to the second actuator.

In use, pressurised hydraulic fluid is selectively admitted into the cylinders 36 and 44 on one or other side of the pistons 34, 42 from a pressurised hydraulic reservoir under the control of solenoid valves or the like which are in turn controlled by an electronic controller, typically the engine management system of the vehicle in which the engine is accommodated to effect the desired movement of the mounting.

In use, the mounting 20, 26 and thus the pivotal axis 21 may remain stationary and, as the crankshaft 10 rotates and the piston 4 reciprocates within the cylinder 2, the axis 16 of the crank 10 describes a circular path 29 and the rod 18 slides in and out of the first mounting member 20, which rocks back and forth about its axis 21. The mounting member 20 restrains the rod 18 from moving linearly transverse to its length. The pivotal axis 12 is constrained by the kinematics of the system to move along a somewhat irregular path 50, shown in the Figure, which has a somewhat deformed oval or substantially elliptical shape. Four specific positions which it occupies during one revolution of the crankshaft are designated 12, 12',12",12'", respectively, and the corresponding positions of the axis 5 are designated 5, 5',5",5'", respectively. The mechanism results in the position/time graph of the piston differing from the conventional sinusoidal shape but the precise manner in which it varies will depend on the relative positions of the axes 12,16 and 21. These are predetermined to produce the required pattern of motion of the piston, e.g. one that approximates to that of the engine disclosed in EP-A-0591153.

The pattern of the motion of the piston may be varied by altering the position of the mounting 20, 26 and thus of the pivotal axis 21. This may be done by selectively actuating the actuator 30 and/or the actuator 32 to move the axis 21 to any desired position. Movement of the position of the axis 21 may be effected at the end of one or more of the piston strokes during each cycle in order to produce different patterns of movement in e.g. the compression and exhaust strokes. Alternatively it may be effected in order to adapt the combustion optimally to different speed and/or load conditions. As a further alternative the axis 21 may be moved in the course of one or more of the piston strokes to produce a desired variation in the pattern of motion of the piston from the sinusoidal. In any event, movement of the mounting may be effected extremely rapidly e.g. under the control of the engine management system which is now provided in most modem automotive engines.

The movement of the mounting by the control means 50 may be effected in response to manual operation of the control means by the user following a decision e.g. to increase the swept volume of the engine. It is, however, preferred that the control means is actuated automatically in response to one or more sensors 51 and 52 which are arranged to produce signals indicative of operating parameters of the engine. Thus in this preferred embodiment the engine includes a knock sensor 51 adjacent the cylinder which operates in a known manner to indicate when knocking or preignition of the engine has commenced or is about to commence. When such a signal is produced by the sensor the control means 50 is arranged to actuate the actuator 30 to move the mounting in a direction which reduces the compression ratio of the engine and thus prevents knocking from occurring. The engine also includes a load sensor 52, e.g. a sensor responsive to the inlet manifold pressure or the throttle position which is arranged to actuate the actuator 30 to decrease the compression ratio as the load increases. As mentioned above, the compression ratio of the engine is varied by altering the top dead centre position of the piston and changes in ignition timing and/or in the swept volume of the piston are compensated for by moving the bottom dead centre position of the piston by actuating the actuator 32 to move the mounting in the direction perpendicular to the cylinder axis.

The engine of the specific embodiment includes four cylinders and whilst each cylinder may be associated with its own first and second movable mounting members and actuators, this is not necessary. Thus in this embodiment there is only a single second mounting member 26 which is common to all the cylinders. There is also preferably only a single first mounting member 20 in the form of an elongate cylinder with four holes formed in it for the accommodation of the four bars 18.

What is claimed is:

1. An internal combustion engine comprising one or more pistons, each of which is mounted to reciprocate in a respective cylinder and is pivotally connected to a connecting rod which is connected to a respective crank on a crankshaft, the connecting rod being pivotally connected to one end of an elongate link member which is pivotally connected to the associated crank at a point intermediate its ends and whose other end constitutes a rod which is restrained by a mounting such that it may pivot about a pivotal axis parallel to the axis of the crankshaft, wherein the mounting includes a first movable mounting member connected to a second movable mounting member to be pivotable with respect thereto about the pivotal axis, the first movable mounting member being connected to the rod by a connection which permits only relative sliding movement in the direction of the rod, and including a first actuator connected to the mounting and arranged to move the mounting selectively in a first direction perpendicular to the axis of the crankshaft and a second actuator connected to the first actuator and arranged to move the first actuator and the mounting in a second direction transverse to the first direction.

2. The engine of claim 1, wherein the first direction is substantially parallel to the axis of the cylinder and the second direction is substantially perpendicular to the axis of the cylinder.

3. The engine of claim 1, wherein the actuators are of hydraulic type.

4. The engine of claim 1, including control means arranged selectively to operate the first and second actuators.

5. The engine of claim 4, including a first sensor arranged to produce a signal indicating that knocking of the engine is commencing, the control means being arranged to operate the first actuator to move the mounting in the first direction to decrease the compression ratio of the engine and thereby cause the knocking to stop.

6. The engine of claim 5, including a second sensor arranged to produce a signal indicative of the load on the engine, the control means being arranged to operate the first actuator to move the mounting in the first direction to vary the compression ratio of the engine with changing load.

7. The engine as claimed in claim 6, wherein the control means is arranged to operate the second actuator to move the mounting in the second direction to compensate for the change in stroke caused by movement of the mounting in the first direction.

8. The engine as claimed in claim 5, wherein the control means is arranged to operate the second actuator to move the mounting in the second direction to compensate for the change in stroke caused by movement of the mounting in the first direction.

9. The engine of claim 4, including a second sensor arranged to produce a signal indicative of the load on the engine, the control means being arranged to operate the first actuator to move the mounting in the first direction to vary the compression ratio of the engine with changing load.

10. The engine as claimed in claim 9, wherein the control means is arranged to operate the second actuator to move the mounting in the second direction to compensate for the change in stroke caused by movement of the mounting in the first direction.

11. The engine of claim 4, including a second sensor arranged to produce a signal indicative of the load on the engine, the control means being arranged to operate the second actuator to move the mounting in the second direction to increase the volume swept by the piston as the load increases.

12. The engine of claim 1, in which the connecting rod is inclined to the axis of the cylinder when the piston is at the top dead center position.

* * * * *